US006349507B1

(12) United States Patent
Muellerleile

(10) Patent No.: US 6,349,507 B1
(45) Date of Patent: Feb. 26, 2002

(54) SLAT WALL STRUCTURE WITH PROFILE FOR DIFFERENT SHELF SUPPORT BRACKETS AND THE LIKE

(75) Inventor: Daniel J. Muellerleile, Grand Haven, MI (US)

(73) Assignee: Spectra Products Corporation, Grand Haven, MI (US)

( * ) Notice: Subject to any disclaimer, the term of this patent is extended or adjusted under 35 U.S.C. 154(b) by 0 days.

(21) Appl. No.: 09/526,436

(22) Filed: Mar. 15, 2000

Related U.S. Application Data

(60) Provisional application No. 60/124,466, filed on Mar. 15, 1999.

(51) Int. Cl.[7] ..... E04B 2/74

(52) U.S. Cl. ..... 52/36.5; 52/36.4; 52/506.01; 312/245; 248/201; 248/165; 248/440.1; 248/247; 108/106; 108/107; 108/108; 211/189; 211/49.01; 40/605; 40/606

(58) Field of Search ..... 52/36.5, 36.4, 52/506.01; 312/245; 248/201, 165, 440.1, 247; 108/106, 107, 108; 211/189, 94.01; 40/605, 606

(56) References Cited

U.S. PATENT DOCUMENTS

| | | | | |
|---|---|---|---|---|
| D178,937 | S | 10/1956 | Stiffel | |
| 3,698,565 | A | 10/1972 | Weber | |
| 3,774,360 | A | 11/1973 | Hubbard et al. | |
| 4,047,349 | A | 9/1977 | Aguilar, Jr. | |
| 4,055,253 | A | 10/1977 | Oztekin | |
| 4,288,958 | A | 9/1981 | Chalmers et al. | |
| 4,323,163 | A | 4/1982 | Johns | |
| D264,284 | S | 5/1982 | Nedermann | |
| 4,429,850 | A | 2/1984 | Weber et al. | |
| 4,450,970 | A | 5/1984 | Shepherd | |
| 4,508,231 | A | 4/1985 | Honickman | |
| D279,201 | S | 6/1985 | Shuman | |
| 4,607,753 | A | 8/1986 | Radek | |
| 4,694,965 | A | 9/1987 | Parnell | |
| 4,726,554 | A | 2/1988 | Sorrell | |
| 4,785,946 | A | 11/1988 | Sorensen | |
| D299,797 | S * | 2/1989 | Walter | 211/128 |
| 4,805,783 | A | 2/1989 | Mayer | |
| 4,825,601 | A | 5/1989 | Halverson | |
| 4,942,498 | A | 7/1990 | Toussaint | |
| 4,961,295 | A | 10/1990 | Kosch, Sr. et al. | |
| 5,018,323 | A | 5/1991 | Clausen | |

(List continued on next page.)

FOREIGN PATENT DOCUMENTS

| | | | |
|---|---|---|---|
| FR | 2667382 | A1 | 4/1992 |

*Primary Examiner*—Carl D. Friedman
*Assistant Examiner*—Chi Nguyen
(74) *Attorney, Agent, or Firm*—Price, Heneveld, Cooper, DeWitt & Litton

(57) ABSTRACT

A slat wall structure including a substantially vertical support portion and at least one substantially horizontal web extending from the support portion. An end of the web includes a downwardly depending portion extending longitudinally along the end of the web, with the downwardly depending portion defining an upwardly extending recess. The recess is located below each of the webs, whereby both hook-like engagement brackets and upwardly extending mounting flange brackets can be supported by the slat wall. The web can also include a downwardly extending portion that defines at least one screw boss, wherein screws are receivable to mount the slat wall from its end. A pair of oppositely disposed and mutually spaced vertical end walls having a slat wall located between and attached to the end walls by screws placed through the vertical end walls and into the screw boss to thereby secure a side of the web to the vertical end walls and form an integral upright assembly which may be self-supporting.

20 Claims, 3 Drawing Sheets

U.S. PATENT DOCUMENTS

| | | | | | |
|---|---|---|---|---|---|
| 5,125,518 | A | | 6/1992 | Ward | |
| D330,646 | S | | 11/1992 | Maas | |
| 5,228,579 | A | | 7/1993 | Kaufman | |
| D338,076 | S | | 8/1993 | Current | |
| D338,355 | S | | 8/1993 | Wells | |
| 5,255,803 | A | | 10/1993 | Pavone et al. | |
| 5,337,987 | A | | 8/1994 | Sawatsky | |
| D351,666 | S | * | 10/1994 | Cole | 52/204.1 |
| 5,370,249 | A | | 12/1994 | Harvey et al. | |
| 5,409,120 | A | * | 4/1995 | Miller | 211/87 |
| 5,412,912 | A | | 5/1995 | Alves | |
| D368,388 | S | | 4/1996 | Schainholz | |
| 5,607,070 | A | | 3/1997 | Hellyer | |
| 5,653,349 | A | | 8/1997 | Dana et al. | |
| D393,907 | S | | 4/1998 | Current | |
| D393,909 | S | | 4/1998 | Current | |
| D395,089 | S | | 6/1998 | Current | |
| D426,089 | S | * | 7/1998 | Vlah | 211/87.01 |
| 5,775,521 | A | | 7/1998 | Tisbo | |
| 5,791,093 | A | | 8/1998 | Diamond | |
| D397,803 | S | | 9/1998 | Current | |
| D399,010 | S | | 9/1998 | Current | |
| D399,012 | S | | 9/1998 | Current | |
| D400,270 | S | | 10/1998 | Current | |
| D403,085 | S | | 12/1998 | Current | |
| D404,148 | S | | 1/1999 | Laskowski et al. | |
| 5,941,026 | A | | 8/1999 | Eisenreich et al. | |
| 5,944,203 | A | | 8/1999 | Vlah et al. | |

* cited by examiner

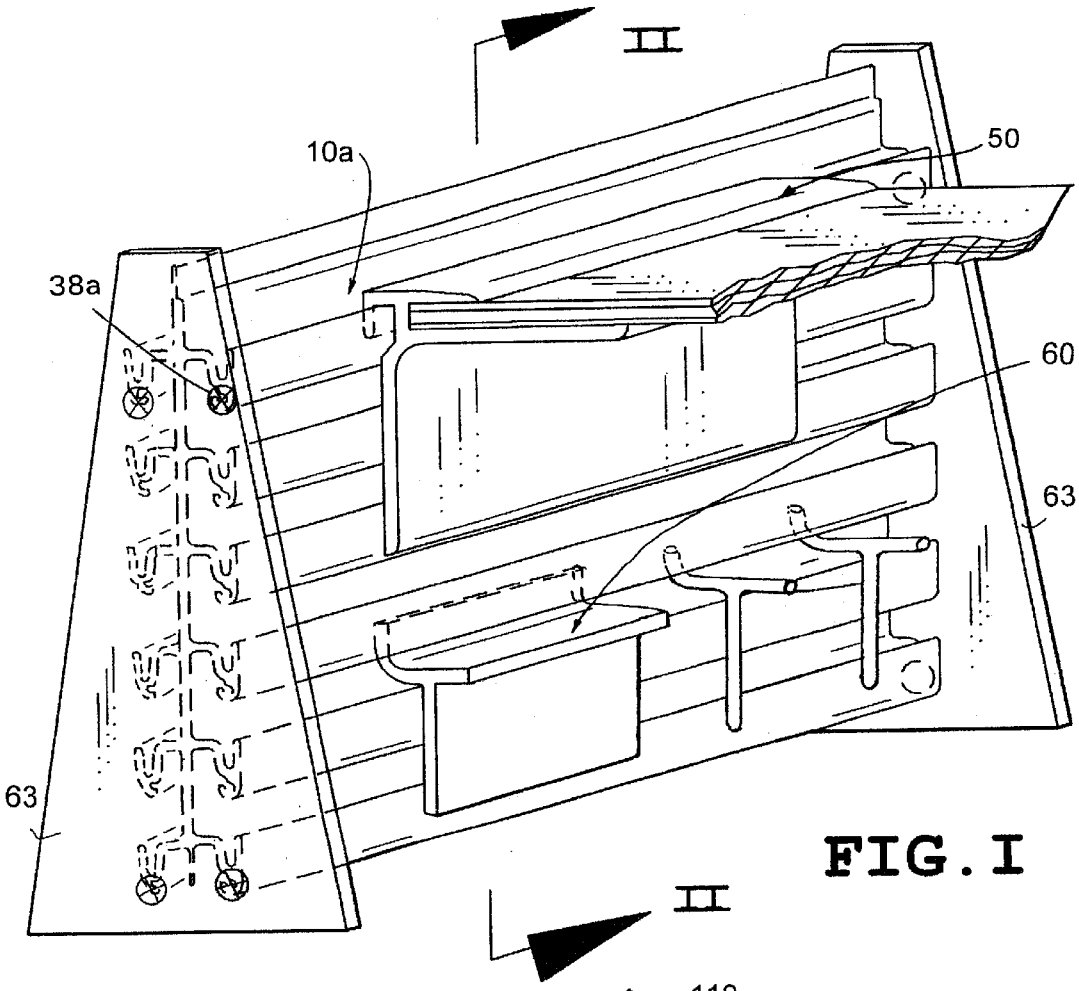
FIG. I
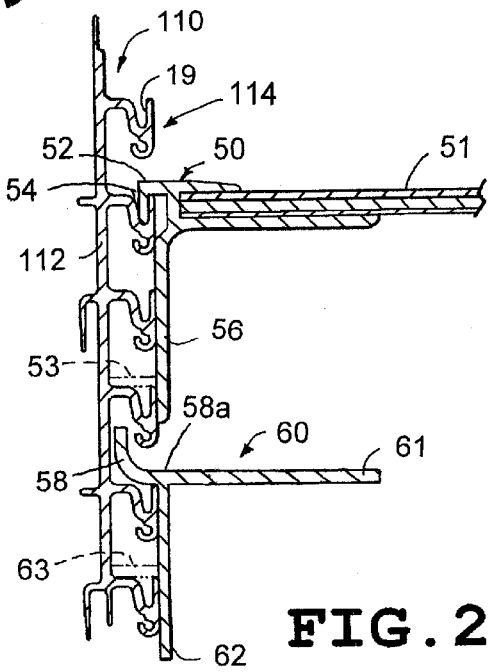
FIG. 2
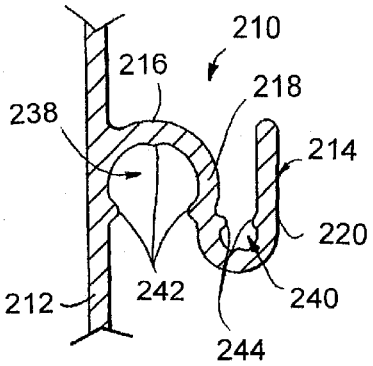
FIG. 3

SLAT WALL STRUCTURE WITH PROFILE FOR DIFFERENT SHELF SUPPORT BRACKETS AND THE LIKE

CROSS-REFERENCE TO RELATED APPLICATIONS

This application claims the benefit of U.S. Provisional Application No. 60/124,466, filed Mar. 15, 1999.

BACKGROUND OF THE INVENTION

The present invention relates to slat wall structures, and in particular to a slat wall structure with a profile which accepts and permits mounting of various different types of support brackets.

Interior product-display walls having a horizontally extending slat-like appearance have come into increased usage and are quite popular as of the present point in time in commercial establishments, since they provide a convenient and highly useful way to display and/or store a variety of different consumer products. This is accomplished through the use of shelf-support or other such brackets that interfit with and are nestingly received by various types of projecting flange-like wall sections or edges that extend horizontally along with and typically define the edge extremities of the horizontally extending "slats" comprising these walls (which are typically formed as an integral part of a multi-slat panel that can be secured to a wall or otherwise vertically supported, and either be fixed or movable).

Examples of two different types of such commercially successful slat wall structures which are made of metal may be seen in prior U.S. Pat. Nos. 3,698,565 and 4,429,850 (which are related) and U.S. Pat. No. 4,961,295 (all incorporated by reference herein), which involve laterally elongated sheet metal structures which are bent or otherwise shaped longitudinally to form generally flat, horizontally extending wall sections which are spaced forwardly of support flanges or the like and which have a horizontal slat-like appearance when supported in vertically spaced relation to other such "slats" or slat wall structures. In the '565 and '850 patents just mentioned, a plurality of such "slats" are formed from a common elongated sheet of material, and thus together comprise a sort of panel which has vertically extending, rearwardly located wall-like sections as well as the forwardly spaced "slat-like" sections. In the '295 patent, the preferred embodiment depicts individual slat-like sheet metal components that are mounted upon and supported in place by vertical hanger strips that are mounted upon various types of vertical supports such as interior walls, columns or studs.

Each of the two different types of metal slat wall mentioned above may be thought of as being generally characteristic of known types of such structures which are presently available commercially, but they have particular profiles which differ considerably from one another in a specific sense, and each is used with a particular and different kind of shelf support bracket (also illustrated in such patents). The support bracket used with the '295 patent is basically of a type generally considered to be the "standard" slat wall bracket, but the ones shown in the '565 and '850 patents are considerably different. As is evident upon even casual consideration, each of these two different types of brackets are so different from one another that they could not possibly be used on the opposite type of slat wall. Accordingly, two distinctly different and completely separate types of support bracket and shelf systems have developed over time, each usable on only one of these two different types of slat wall structure. Therefore, purchasers and users have been significantly restricted in their available choices once they have purchased one or the other type of slat wall system.

SUMMARY OF THE INVENTION

The present invention recognizes the practical problem created by the mutually different slat wall systems described above, and provides a solution for the user/consumer, by which either of the two different types of support bracket in common usage may be used on the same type of slat wall. More particularly, the present invention provides a new and highly useful slat wall configuration or profile which will securely and supportively mount, and retain in place, either of the two different types of support brackets mentioned above. Accordingly, the present invention provides a universally useful new slat wall configuration which will free those who have previously invested in one or the other type of prevalent slat wall configurations described above, allowing them to purchase and use shelf supports or other such brackets of either type, depending upon their needs and desires, thereby greatly extending the usefulness of the systems in which they have invested and generally prompting competition as well.

BRIEF DESCRIPTION OF THE DRAWINGS

FIG. 1 is a perspective view of a slat wall structure embodying the present invention.

FIG. 2 is a side view of the slat wall of the first alternative embodiment of the present invention.

FIG. 3 is a front isometric view of the slat wall of the first alternative embodiment of the present invention.

DETAILED DESCRIPTION OF THE PREFERRED EMBODIMENTS

For purposes of description herein, and in the appended claims, the terms "upper," "lower," "right," "left," "rear," "front," "vertical," "horizontal," and derivatives thereof should be understood as relating to the invention as orientated in FIG. 1. However, it is to be understood that the invention may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 4:
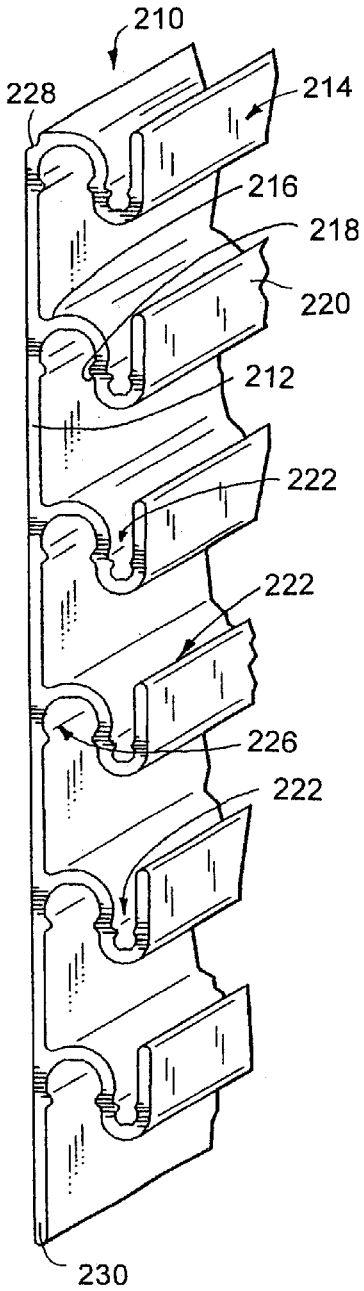
FIG. 4 is a front isometric view of the slat wall of the second alternative embodiment of the present invention.

A first embodiment 10 and second embodiment 110 of the new slat wall configuration/profile is shown in detail in FIGS. 3 and 4, which depict the same as comprising a laterally elongated one-piece panel-like structure having a continuous vertical plate-like backing wall or section 12, 112, which supports in place a plurality of horizontally extending, 30 mutually spaced slat-like sections or elements 14, 114, comprising the "slats." Each of the slat elements 14, 114 is spaced outwardly of and disposed generally parallel to the backing wall section 12, 112, and supported in place by a horizontally extending rib or flange 16 that is oriented generally perpendicular to the vertical backing wall or section 12, 112, and integrally joined to the latter. Ribs or flanges 16 extend outwardly from backing wall 12, 112 in generally horizontal relation for a predetermined distance, and then extend downwardly to define an angular section 18 which, at its lowermost extremity, extends outwardly to connect with the slat wall sections 14, 114 at approximately their vertical midpoint, where the sections 18 integrally join the slat wall elements and support the latter in place. As will be appreciated, the integral slat wall structures 10, 110 as just described may readily be manufactured as an extrusion, and a preferred embodiment of the same as presently contemplated would be an aluminum extrusion.

The structure of the slat wall embodiments 10, 110 described above provides a vertically extending portion 20 of the slat wall elements 14 which is disposed above the meeting point or junction of the slat wall elements with the angular section 18 of rib or flange 16. Between the wall portions 18 and 20, a first mounting recess 22 is defined, as referred to further below. The lower portion 24 of slat wall elements 14, 114, which is located below the junction of the latter with the angular section 18 of rib 16, defines an upwardly opening recess 26 that comprises a second mounting/retention area for accessory parts such as shelf support brackets, as will be explained further below. As illustrated, the lowermost extremity of lower slat wall portion 24 may be curved inwardly for added strength and retention security, and may form a screw boss as discussed below.

As illustrated in FIGS. 3 and 4, the slat wall panel structures 10, 110 comprise one-piece generally rigid structures which, from the front side (i.e., the side on which the slat wall elements 14, 114 are located) has the appearance of a laterally elongated wall having a plurality of separate vertically spaced, horizontally extending slat elements which are disposed forwardly of the remaining parts of the structure. Each such slat wall panel section is made to interfit with another such section located either above or below it, and to facilitate this, both the top and the bottom portions 28, 128, and 30, 130, respectively, of their backing wall sections 12, 112 are preferably recessed horizontally to provide complementary top and bottom flange sections that will smoothly overlap with the corresponding portion of another such slat wall section disposed above or below, whereby a continuous vertical wall structure may be provided.

As indicated above, the embodiment 10 of FIG. 3 is intended for direct flush mounting against an existing vertical wall or other such support (stud wall, etc.), and thus has a smooth flat surface on the near side of its backing wall section 12. Also, a series of screw-receiving recesses 32 (FIG. 3) may be provided in the front side of the backing wall to facilitate screw insertion at any desired point along their length. The embodiment 110 of FIG. 4 is intended for mounting upon a support bracket such as that disclosed in the aforementioned U.S. Pat. No. 4,961,295, which has upwardly extending tabs or tangs. Thus, the embodiment 110 of FIG. 4 includes a series of rearwardly and downwardly extending horizontal rib sections 34 on the near side of its backing wall 112, which comprise hangers that will hook over such upstanding support tabs to thereby mount the slat wall structure 110 thereupon. To facilitate this mounting and provide further positioning support, a series of rearwardly-extending abutment ribs 36 may also be provided, sized to come into direct contact with the portion of the aforementioned mounting bracket between its upstanding support tabs.

In the embodiment 110 of FIG. 4, the lowermost portion 124 of the slat wall element 114 is curved further inwardly toward the backing wall section 112 than was the case in the embodiment 10 of FIG. 3, to illustrate a further aspect of this portion of the structure. That is, lower portion or segment 124 is circularly curved over an area in excess of 180°, to define a screw boss 38. This type of structure, or structural feature, may also be implemented in the embodiment 10, of FIG. 3 and, as discussed further below (and illustrated in FIG. 1), it is useful for supporting the slat wall panel 10 or 110 between a pair of vertical end wall sections 63 (FIG. 1) through which screws 38*a* pass to enter and thread tightly into the bosses 38. This type of structure is typically free-standing, and therefore no wall or other such vertical support behind the slat wall panel is necessary, and in fact the slat wall panel(s) used in this configuration may be double-sided, i.e., may have slat elements on both the front and back, as exemplified by the embodiment 10*a* of FIG. 1, for display of merchandise or the like on each opposite side.

Figure 5:
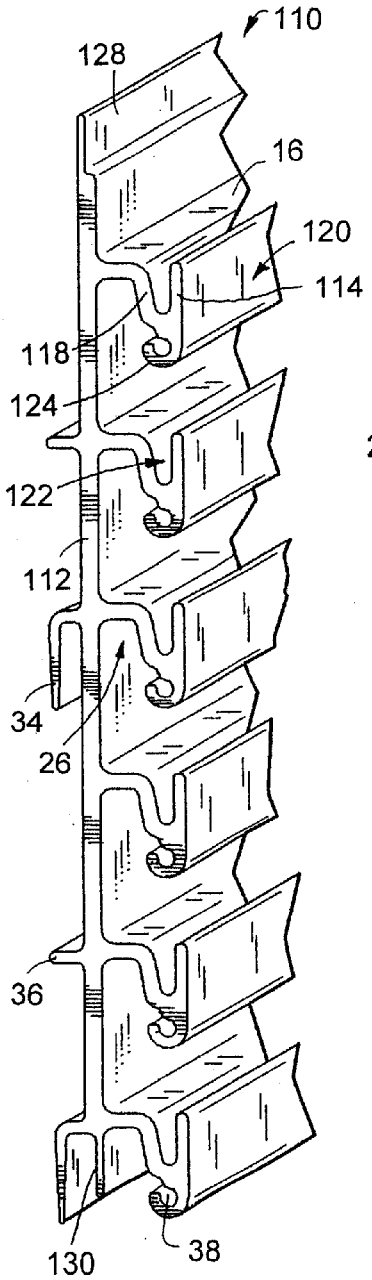
FIG. 5 is a front isometric view of the slat wall of the third alternative embodiment of the present invention.
Figure 6:
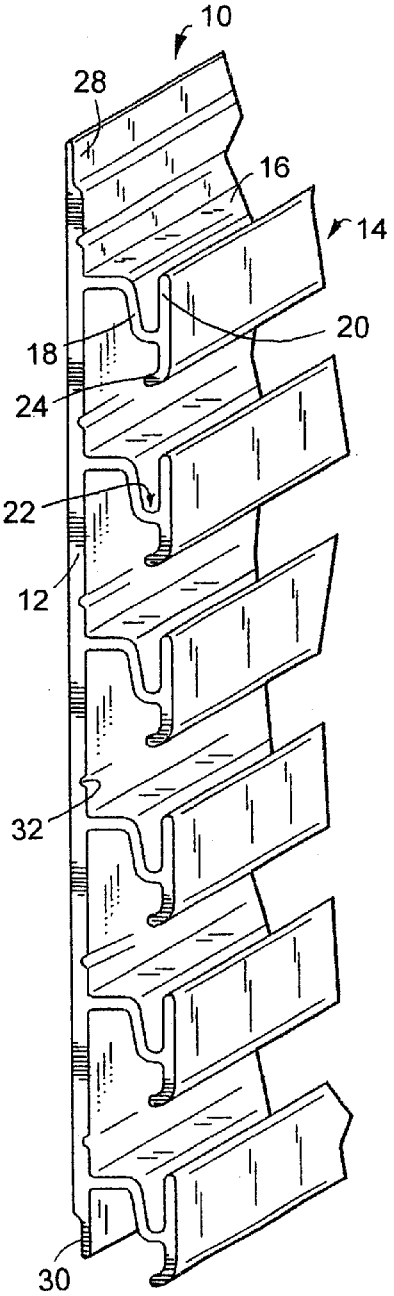
FIG. 6 is a side view of a slat wall of the third alternative embodiment of the present invention.

A refinement or modification of the slat wall panels 10, 110 of FIGS. 3 and 4, respectively, constituting a preferred embodiment and best mode of the present invention, is illustrated in FIGS. 5 and 6, wherein it is designated by the numeral 210. Like the previous embodiments 10 and 110, slat wall panel 210 includes a vertically extending support wall or backing plate section, designated 212, and a plurality of laterally extending slat wall elements, designated 214, which are supported in place thereon and preferably made as a one-piece unit therewith by extrusion or the like. Each of the slat wall elements 214, like the analogous elements 14 and 114 discussed above, includes an outwardly extending rib or flange 216, a downwardly and outwardly extending section 218, and an outer slat element or portion 220 which is integrally connected with portions 218 and 216 as a continuous structure. As made evident in FIGS. 5 and 6, the outer slat portion 220 joins the downwardly and outwardly extending mid portion 218 at their respective lowermost extremities, rather than at a point between the top and bottom of portion 220, as in the embodiments of FIGS. 1, 2, 3, and 4. Further, the rib or flange portion 216 is curved rather than substantially straight over its extremity, unlike the analogous portions 16 and 116 illustrated in FIGS. 3 and 4.

The structural refinements or revisions of embodiment 210 are principally implemented to provide the most efficient and most economically produced form of the invention for manufacture by extrusion, but in a functional sense this embodiment provides the same basic advantages and purposes of the embodiments 10 and 110 discussed above and referred to subsequently herein. One further aspect of the preferred embodiment 210 is that it is preferably formed so as to provide a pair of differently-sized screw bosses 238, 240, which are analogous to the screw boss 38 illustrated in FIG. 3 and discussed above, and provided for the same purpose. To further carry out this purpose, a plurality of horizontally extending parallel ridges 242 are preferably provided as an integral part of the structure forming screw boss 238, and extend longitudinally along the inside of the latter to ensure positive contact with screws which are used for mounting slat wall panel 210 at its ends, in the manner discussed above in connection with FIG. 3 and illustrated in FIG. 1. Similarly, screw boss 240 preferably includes a similar plurality of mutually spaced longitudinal internal ridges 244 (FIG. 6). As illustrated, screw boss 238 has a larger diameter than boss 240, for receiving larger and stronger screws (or bolts), as may be desirable in large-size installations.

Figure 7:
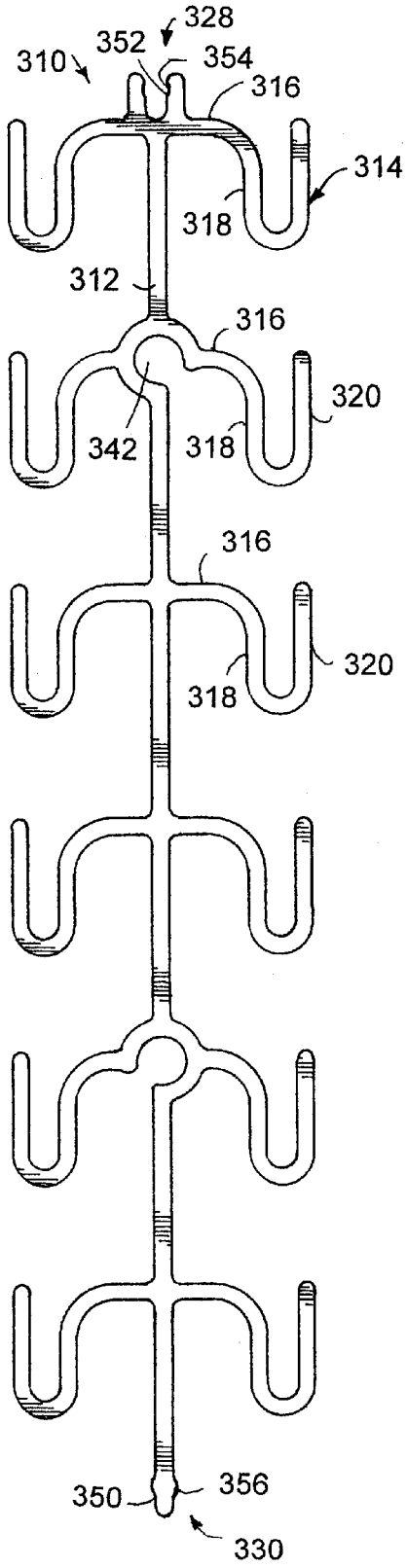
FIG. 7 is a side view of a slat wall of the fourth alternative embodiment of the present invention.

Another refinement or modification of the slat wall panels 10, 110 of FIGS. 3 and 4, respectively, constituting a fourth embodiment of the present invention, is illustrated in FIG. 7, wherein it is designated by the numeral 310. Like the previous embodiments 10, 110 and 210, slat wall panel 310 includes a vertically extending support wall or backing plate section, designated 312, and a plurality of laterally extending slat wall elements, designated 314, which are supported in place thereon and preferably made as a one-piece unit therewith by extrusion or the like. Each of the slat wall elements 314 are like the analogous elements 14, 114 and 214 discussed above, and include an outwardly extending rib or flange 316, a downwardly and outwardly extending section 318, and an outer slat element or portion 320, which is connected with portions 318 and 316 as a continuous structure. As made evident in FIG. 7, the outer slat portion 320 joins the downwardly and outwardly extending mid-portion 318 at their respective lowermost extremities, rather than at a point between the top and bottom of portion 320, as in the embodiments of FIGS. 1–4.

The illustrated slat wall 310 includes a top portion 328 and a bottom portion 330 such that the slat wall 310 is made to interfit with another such slat wall 310 located either above or below it. The bottom portion 330 has a rounded end 350 shaped to interfit into a channel 352 of the top portion 328 in a tongue and groove-like manner. The rounded portion 350 and the channel 352 also include an interfitting flange 356 and a recess 354, respectively, to interlock adjacent slat walls 310. As illustrated, the backing plate section 312 includes a series of screw bosses 342 located between slat wall elements 314 on opposite sides of the backing wall section 312. The screw bosses 342 facilitate screw insertion and are useful for supporting the slat wall panel 310 between the pair of vertical end wall sections 62 through which screws 38*a* pass to enter and thread tightly into the bosses 342, similar to the embodiment 10*a* of FIG. 1.

Each of the slat wall panel embodiments 10, 110, 210 and 310 discussed above and illustrated in the various figures (particularly FIGS. 3, 4, 5, 6 and 7) provide the desirable advantage, referred to previously, of accepting and supporting in place each of the two most prevalent types of support brackets commonly used to mount display shelves, trays, hooks, and a variety of other such structures upon slat walls, for the display of merchandise thereon at a position spaced outwardly from the outermost surface of the slat elements 14, 114, 214, 314. The manner in which this is accomplished is illustrated in FIGS. 1 and 2, in which two such different types of prior art brackets or supports 50, 60 are illustrated in mounted position upon slat wall panel 10*a* of FIG. 1 and 110 in FIG. 2 (which illustrations should be considered typical of and true with respect to the slat wall panel embodiments 210 and 310 as well).

Referring more particularly to FIG. 2, it will be observed that prior art bracket type 50 has a top part 52 which terminates in a downwardly extending mounting flange portion 54, which provides its principal support. In accordance with the present invention, the ribs or flange portions 18 and 20 defining the slat element 14 are spaced apart to provide a recess 22 therebetween, and this is proportioned so as to conformably receive the downwardly extending mounting flange 54 of bracket 50. This hook-like engagement provides the vertical support (bears the weight) of bracket 50 and a shelf 51 or the like which it is designed to support in place; however, this manner of mounting and supporting an outwardly-positioned weight will of course produce a moment arm about flange 54 and recess 22 as a pivot point. Consequently, bracket 50 includes a lower portion 56 comprising a vertically extending abutment flange which is sized and positioned so as to lie in flush abutment against the outer face of one or more of the adjacent slat portions 20 located immediately below the one on which bracket 50 is so hung (as illustrated in FIG. 2). As also illustrated in this figure, the upward extent of slat wall portion 20 of this embodiment is preferably sized so as to make contact with the underside of bracket top part 52 when the latter is hung upon it in the manner just described. While the depth of recess 22 is preferably sized so that mounting flange 54 bottoms in it when slat portion 20 lies in contact with the underside of bracket top part 52, as just described, the latter such relationship (engagement of the top of slat portion 20 with the underside of bracket top part 52) is the one to which the higher priority should be given.

As already indicated, FIG. 2 also depicts the mounting of what is known as a "standard" type shelf support bracket 60 upon slat wall panel 110 (as an example of all three such embodiments disclosed), and also the mounting of similarly configured hooks or pegs 64. As illustrated, bracket 60 has a rearwardly and upwardly extending mounting flange 58 which projects upwardly into and is received within the space 26 provided between the slat structure 114 and vertical support wall 112. Furthermore, mounting flange 58 has a horizontal section 58*a* whose underside lies upon the top of slat wall portion 20 to provide the primary load-bearing point, in the same manner as that described above in connection with bracket 50. In addition, a vertical lower portion 62 of bracket 60 lies flush against the face of slat structures 14 disposed immediately below the one on which bracket 60 is hung by its mounting flange 58, to resist any moment arm about the primary load-bearing point located above. In the case of shelf-support bracket 60, an integrally formed shelf portion 61, generally analogous to shelf portion 51 of bracket 50 discussed above, is attached to the bracket portion and projects outwardly therefrom to support merchandise or the like. (The particularities of brackets 50 and 60 are not specifically a part of the invention, and in fact are part of the prior art). In this arrangement, weight applied to the outwardly projecting shelf portion 61 of bracket 60 (which typically is canted upwardly at least slightly, as illustrated in FIG. 2) bears downwardly upon the slat structure 114 upon which the bracket is hung, and any outward disengaging movement of the bracket relative to the slat upon which it is hung is resisted by engagement of the upwardly extending mounting flange 58 against the rear side of the slat structure 114 disposed immediately above (in particular, the curved lower extremity thereof.

As illustrated in FIG. 1, the support bracket 60 and its integral shelf portion 61 may have a lateral width different from that of bracket and shelf 50, 51, and may be either wider or narrower than the latter. Further, a directly similar but very narrow support bracket 60*a* may be used with an integral or attached peg-like or other such hook 61*a* on which merchandise may be hung. All of these represent known, commercially available equipment, of which there may be numerous other specific types as well. The main point is, the invention makes all of them mountable on the same slat wall panel, along with the other type of support bracket 50.

Accordingly, it will be seen from the foregoing that all three of the slat wall panel embodiments 10, 110, 210 and 310 disclosed herein provide the "universal" display bracket mounting function described in connection with FIG. 2, since each of the embodiments will reliably mount and retain in place either or both types of the known support brackets 50 or 60. Thus, by utilizing the novel slat wall panel of the present invention, a merchandiser may continue using either type of such bracket he or she may happen to have acquired previously but is at the same time free to acquire either type of bracket in the future, since each are made to be equally useful by the present invention.

By way of further illustration of the general type of known of shelf support brackets 50 depicted in FIG. 2, a variety of alternative embodiments of that bracket are illustrated in the aforementioned U.S. Pat. No. 4,429,850 (i.e., FIGS. 2, and 3 thereof. These further showings are merely referred to herein as further examples of known display support brackets which are mountable by using the novel slat wall panel configuration provided hereby. In this regard, it should be appreciated that the embodiment shown in FIG. 2 of the above patent has a rearwardly extending abutment portion at its lowermost extremity which is proportioned so as to make into direct abutment with the outer (front) surface of vertical support wall 112, but it will be recognized that this is equally applicable to the present invention and this is the purpose of the additional portions 53, 63 shown in phantom in FIG. 2, which obviously should be located so as to lie between a pair of vertically adjacent slat structures 114 or the like.

The purposes, objectives, and advantages of the invention will be understood by those skilled in the art following consideration of the foregoing description and attached drawings. Of course, the above description is addressed to the preferred embodiments only. Modifications of these embodiments may occur to those skilled in the art and to those who make or use the invention, without departing from the underlying invention itself. Therefore, it is to be understood that the particular embodiments shown in the drawings and described above are merely for illustrative purposes and these should not be interpreted as limiting the scope of the invention.

What is claimed is:

1. A slat wall for supporting hook-like engagement brackets and upwardly extending mounting flange brackets comprising:

a substantially vertical support portion;

at least one substantially horizontal web extending from said support portion, an end of the web including a downwardly depending portion extending longitudinally along the end of the web, the downwardly depending portion defining an upwardly extending recess;

wherein the recess is located below the at least one web, whereby both hook-like engagement brackets and upwardly extending mounting flange brackets can be supported by the slat wall;

wherein the downwardly depending portion defines at least one screw boss adapted to receive screws placed through vertical end walls, to thereby secure the ends of the webs to the vertical end walls.

2. The slat wall of claim 1, wherein:

the downwardly depending portion defines two screw bosses.

3. The slat wall of claim 2, wherein:

a first screw boss of the two screw bosses is located below the web.

4. The slat wall of claim 3, wherein:

the downwardly depending portion has a substantially U-shaped cross-section;

and a second screw boss of the two screw bosses is located within the downwardly depending portion.

5. The slat wall of claim 1, wherein:

the downwardly depending portion has a substantially Y-shaped cross-section;

and the at least one screw boss is located within a bottom leg of the substantially Y-shaped cross-section.

6. The slat wall of claim 1, wherein:

the at least one screw boss is circularly curved over an area of about 180°.

7. A slat wall for supporting hook-like engagement brackets and upwardly extending mounting flange brackets comprising:

a substantially vertical support portion;

at least one substantially horizontal web extending from said support portion, an end of the web including a downwardly depending portion extending longitudinally along the end of the web, the downwardly depending portion defining an upwardly extending recess;

wherein the recess is located below the at least one web, whereby both hook-like engagement brackets and upwardly extending mounting flange brackets can be supported by the slat wall;

wherein the support portion includes a rearward side and mounting elements on said rearward side for mounting the slat wall on complementary support members attached to existing vertical support surfaces.

8. A slat wall for supporting hook-like engagement brackets and upwardly extending mounting flange brackets comprising:

a substantially vertical support portion;

at least one substantially horizontal web extending from said support portion, an end of the web including a downwardly depending portion extending longitudinally along the end of the web, the downwardly depending portion defining an upwardly extending recess;

wherein the recess is located below the at least one web, whereby both hook-like engagement brackets and upwardly extending mounting flange brackets can be supported by the slat wall;

wherein said substantially vertical support portion defines at least one screw boss adapted to receive screws placed through vertical end walls, to thereby secure the slat walls to the vertical end walls.

9. A slat wall comprising:

a substantially vertical support portion;

at least one substantially horizontal web extending from the support portion;

the web including a downwardly depending portion defining at least one screw boss wherein screws can be placed through vertical end walls and into the screw boss to thereby secure a side of the web to the vertical end walls.

10. The slat wall of claim 9, wherein:

the downwardly depending portion defines two screw bosses.

11. The slat wall of claim 10, wherein:

a first screw boss of the two screw bosses is located below the web.

12. The slat wall of claim 11, wherein:

the downwardly depending portion has a substantially U-shaped cross-section;

and a second screw boss of the two screw bosses is located within the downwardly depending portion.

13. The slat wall of claim 9, wherein:

the downwardly depending portion has a substantially Y-shaped cross-section;

and the at least one screw boss is located within a bottom leg of the substantially Y-shaped cross-section.

14. The slat wall of claim 9, wherein:

the at least one screw boss is circularly curved over an area of at least 180°.

15. The slat wall of claim 9, wherein:

the support portion and the at least one substantially horizontal web are formed from an extruded one-piece member.

16. The slat wall of claim 9, wherein:

the downwardly projecting portion has a generally vertical outer face portion for serving as a stabilizing abutment to help retain a support bracket in place.

17. The slat wall of claim 9, wherein:

the support portion includes mounting elements on a rearward side for mounting the slat wall on complementary support members attached to existing vertical support surfaces.

18. The slat wall of claim 9, wherein:

at least one substantially horizontal web includes a plurality of substantially horizontal webs extending generally parallel to one another in mutually spaced horizontal disposition.

19. A slat wall structure for supporting hook-like engagement brackets and upwardly extending mounting flange brackets comprising:

a pair of oppositely disposed and mutually spaced vertical end walls; and a slat wall located between and attached to the end walls;

the slat wall including a substantially vertical support portion and at least one substantially horizontal web extending from the support portion;

an end of the web including a downwardly depending portion extending longitudinally along the end of the web, the downwardly depending portion defining an upwardly opening recess;

wherein the recess is located below each of the webs, whereby both hook-like engagement brackets and upwardly extending mounting flange brackets can be supported by the slat wall.

20. A slat wall structure comprising:

a pair of oppositely disposed and mutually spaced vertical end walls; and a slat wall located between and attached to the end walls;

the slat wall including a substantially vertical support portion and at least one substantially horizontal web extending from the support portion;

the web including a downwardly extending portion defining at least one screw boss, wherein screws are receivable through the vertical end walls and into the screw boss to secure a side of the web to the vertical end walls.

* * * * *